United States Patent [19]

Allen

[11] Patent Number: 4,703,673

[45] Date of Patent: Nov. 3, 1987

[54] CORK-EXTRACTING APPARATUS

[75] Inventor: Herbert Allen, Houston, Tex.

[73] Assignee: Hallen Company, Houston, Tex.

[21] Appl. No.: 721,235

[22] Filed: Apr. 8, 1985

[51] Int. Cl.[4] ..... B67B 7/04

[52] U.S. Cl. ..... 81/3.29; 81/3.45

[58] Field of Search ..... 81/3.29, 3.34, 3.48, 81/177.2, 3.45; 16/115

[56] References Cited

U.S. PATENT DOCUMENTS

| | | | |
|---|---|---|---|
| 35,362 | 5/1862 | Chinnock . | |
| 54,039 | 4/1866 | Swartz . | |
| 73,677 | 1/1868 | Twigg . | |
| 172,868 | 2/1876 | Clough . | |
| 181,147 | 8/1876 | Decker . | |
| 276,804 | 5/1883 | Green . | |
| 427,099 | 5/1890 | Middlekauff . | |
| 518,018 | 4/1894 | Becker . | |
| 814,834 | 3/1906 | Coughlin . | |
| 2,382,291 | 8/1945 | Carlberg | 16/115 X |
| 2,980,456 | 4/1961 | McMullin | 16/115 X |
| 3,256,756 | 6/1966 | Del Piccolo | 87/3.48 |
| 4,276,789 | 7/1981 | Allen . | |
| 4,291,597 | 9/1981 | Allen . | |
| 4,377,096 | 3/1983 | Allen . | |
| 4,429,444 | 2/1984 | Allen . | |

FOREIGN PATENT DOCUMENTS

| | | | |
|---|---|---|---|
| 705901 | 6/1931 | France | 81/3.29 |
| 1201854 | 7/1959 | France . | |
| 246954 | 11/1947 | Switzerland | 81/3.48 |
| 257086 | 3/1949 | Switzerland | 81/3.48 |

OTHER PUBLICATIONS

*Corkscrews for Collectors,* Bernard M. Watney and Homer D. Babbidge Sotheby Parke Bernet, New York, 1981, pp. 17, 20–28, 37, 40–41, 61, 65, 98, 101 and 105.

The Wonderful Screwpull Brochure, Hallen Company, Sep., 1982.

*Primary Examiner*—Roscoe V. Parker

*Attorney, Agent, or Firm*—Browning, Bushman, Zamecki & Anderson

[57] ABSTRACT

Apparatus for extracting a cork from a bottle comprises a movable portion, a handle, and a holder. The movable portion includes a helical corkscrew. The handle includes at least one elongate arm and is associated with the movable portion such that the arm may extend radially outwardly with respect to the corkscrew in an operating position of the handle. The arm has a restraining formation disposed distal the corkscrew in the operating position and adapted to engage a human finger and restrain it against movement radially outwardly. The holder is engageable with a bottle and defines an opening for receipt of a cork as it emerges from the bottle. The holder has a guide which allows rotational and longitudinal movement of the movable portion relative to the holder whereby the corkscrew can be driven downwardly into the cork and to a lowered position with respect to the holder upon rotation of the movable portion in a first direction. The movable portion and the holder have force transmitting formations interengageable, when the movable portion is in its lowered position, and adapted to cause the cork to be removed from the bottle upon further rotation of the movable portion.

33 Claims, 18 Drawing Figures

FIG. 2
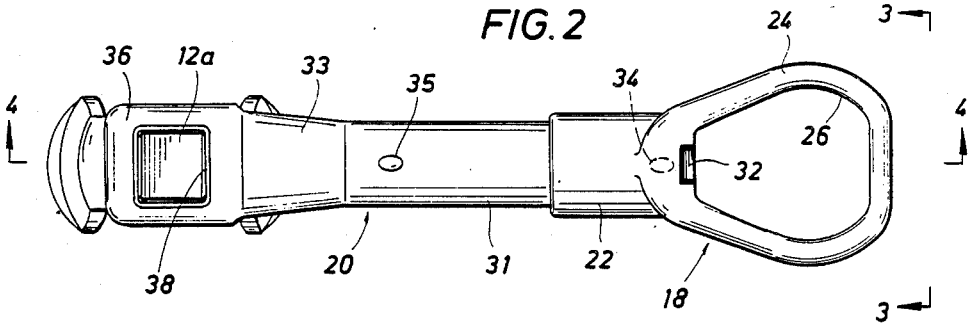
FIG. 1
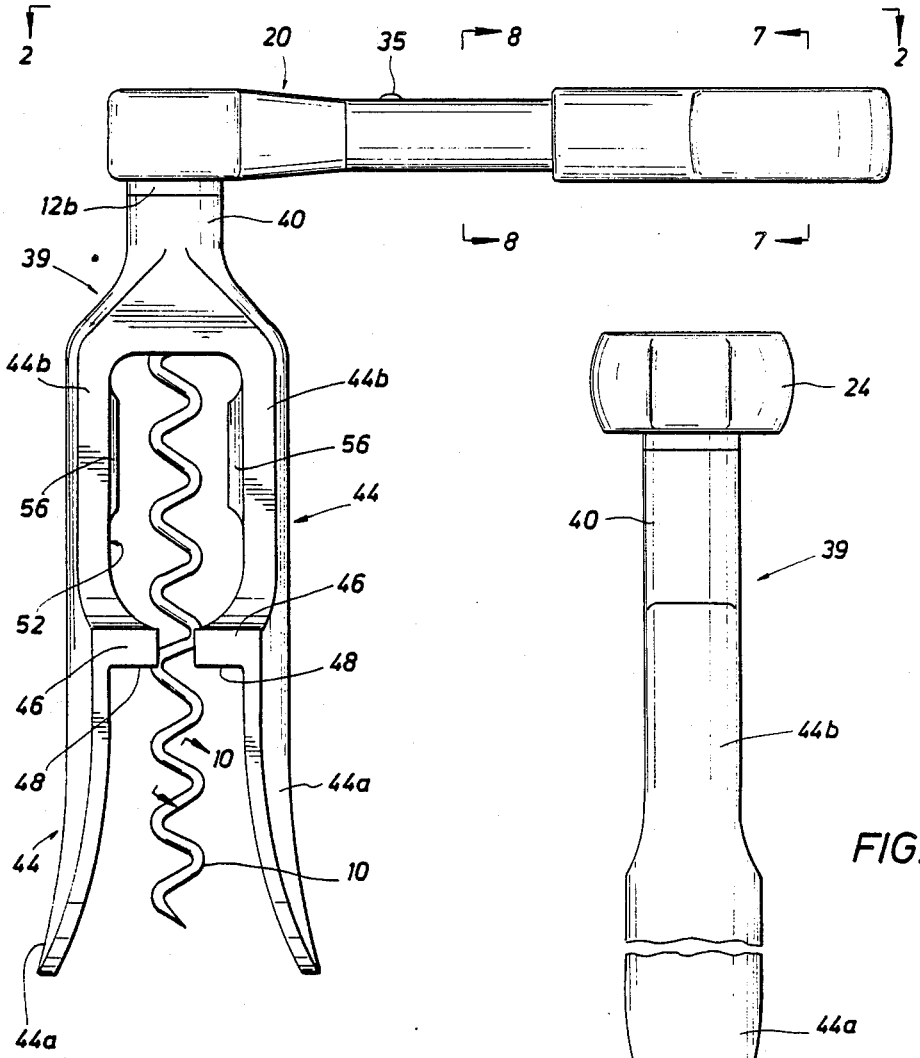
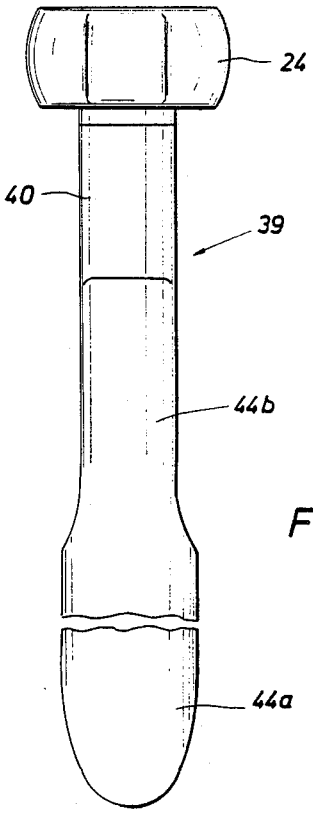
FIG. 3
FIG. 10
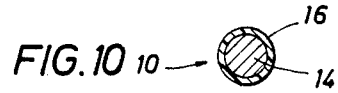

FIG. 6
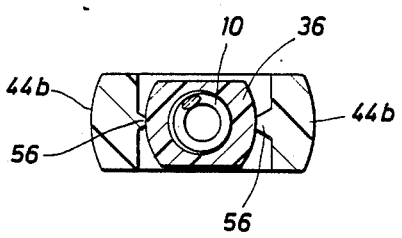
FIG. 7
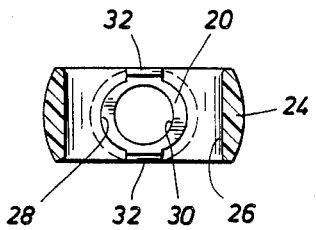
FIG. 8
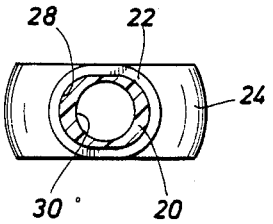
FIG. 9
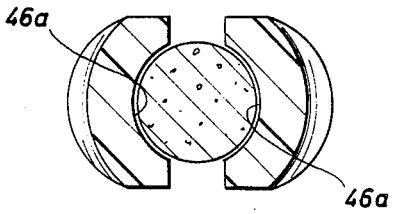
FIG. 11
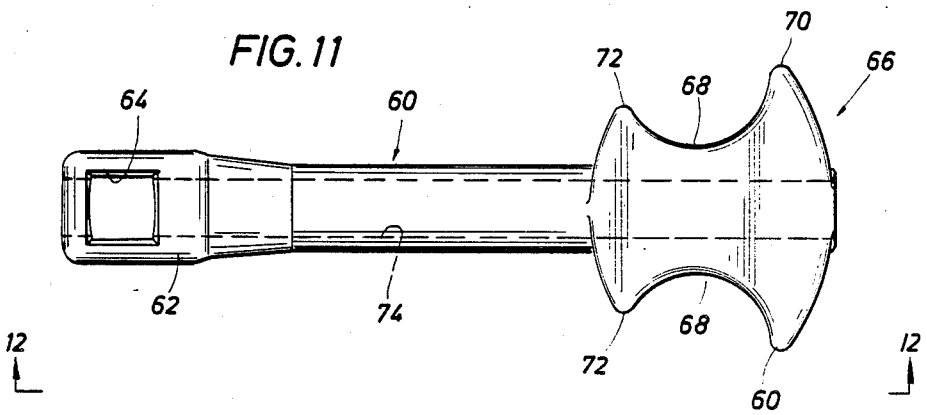
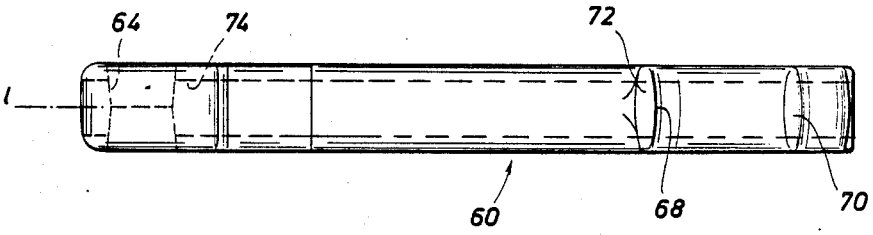
FIG. 12

FIG. 14
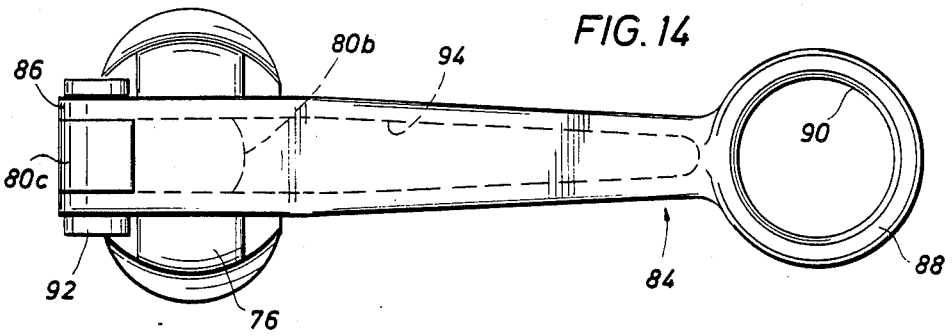
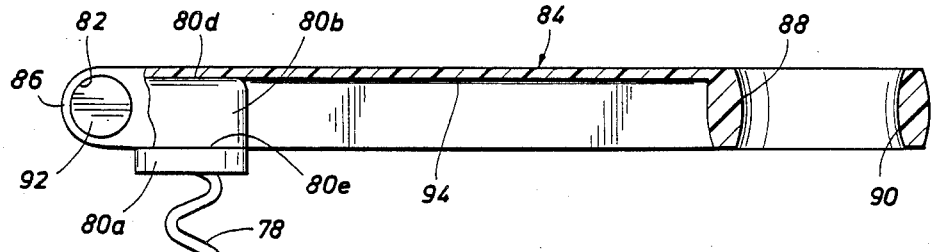
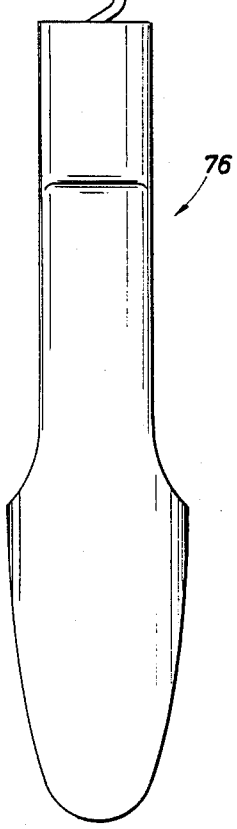
FIG. 13
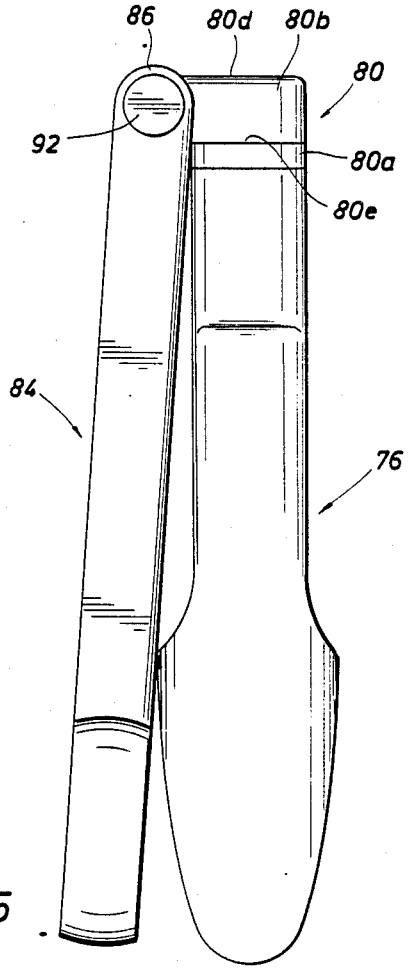
FIG. 15

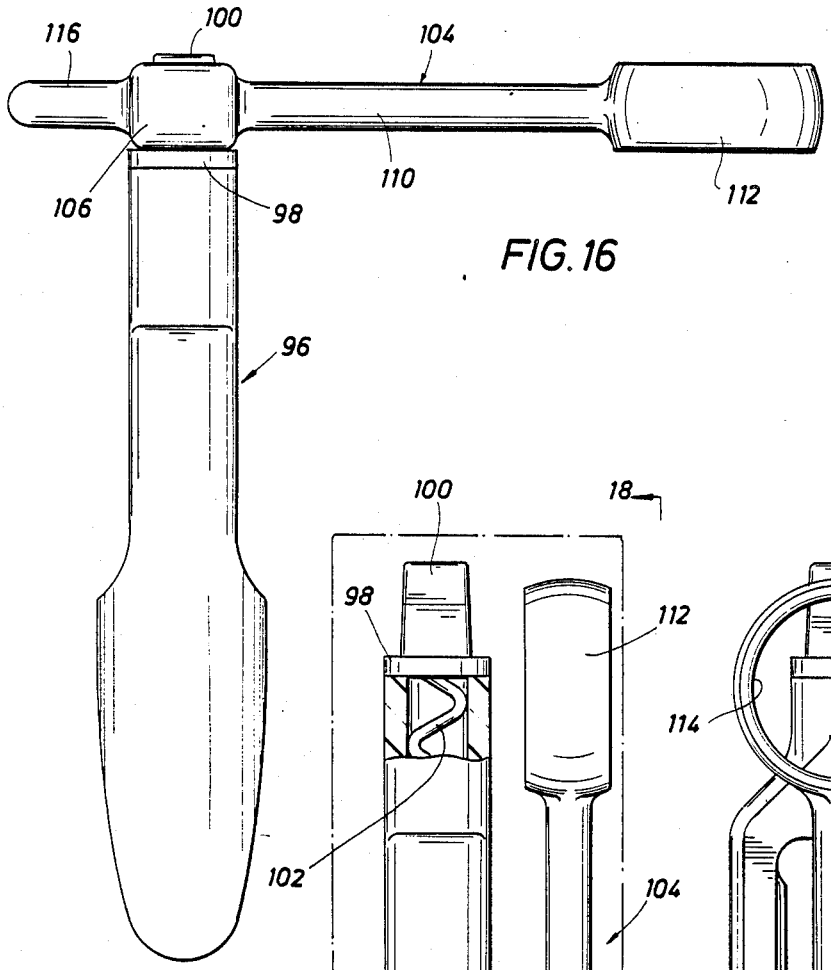
FIG. 16
FIG. 18
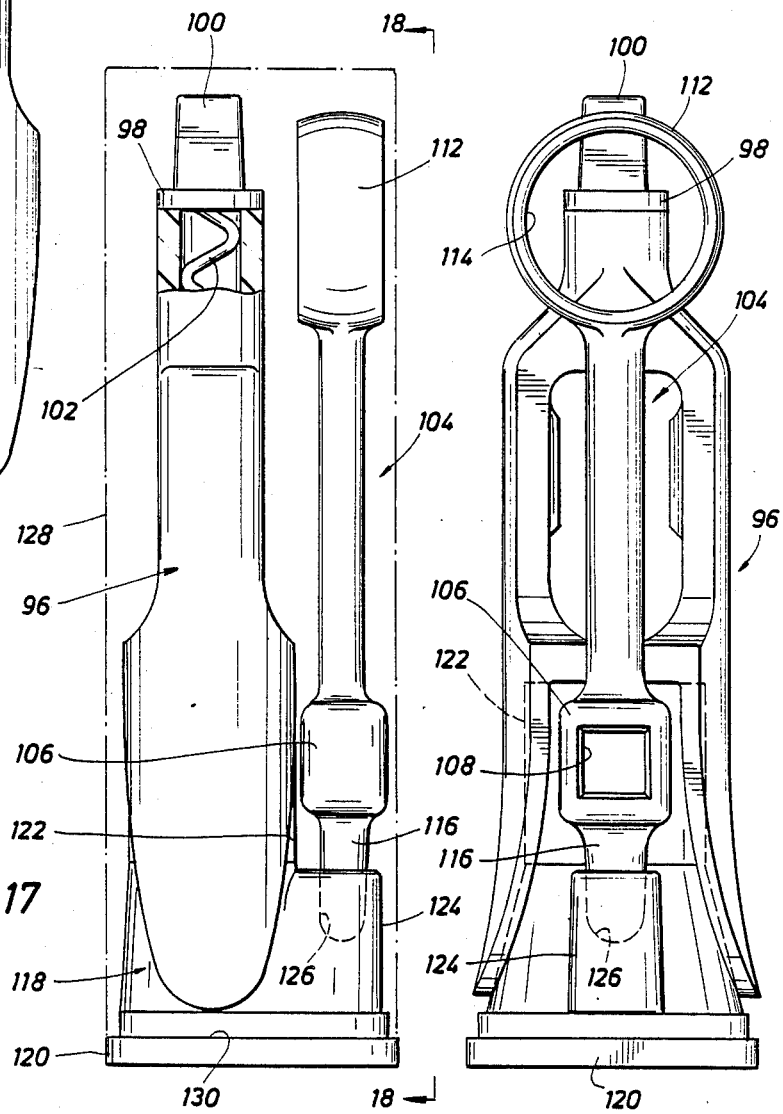
FIG. 17

CORK-EXTRACTING APPARATUS

BACKGROUND OF THE INVENTION

The present invention generally pertains to apparatus for extracting corks from bottles, and more particularly, to the type of apparatus generally shown and described in U.S. Pat. Nos. 4,276,789, 4,291,597, 4,377,096 and 4,429,444 of the present inventor. The excellence of cork extractors made in accord with said prior patents has been highly acclaimed by numerous persons, both experts and ordinary consumers alike. The present invention provides certain improvements of particular value to those, such as waiters, caterers, flight attendants and the like, who must sometimes open a relatively large number of bottles of wine in fairly quick succession and/or who need to carry the cork-extracting apparatus on their persons, although the present invention is also suitable for more ordinary use.

U.S. Pat. Nos. 4,276,789 and 4,291,597 disclose the type of apparatus to which the present invention is applied. Such apparatus includes a helical corkscrew with a handle attached thereto. A holder is provided for engaging a bottle to be opened and positioning and guiding the corkscrew in its movements with respect to such bottle and the cork therein. The device is operated by first driving the corkscrew into the cork by simultaneous rotation and downward movement relative to the holder. When the handle comes into abutment with the top of the holder, thereby preventing further downward movement, the corkscrew will have its lower portion driven into the cork and its upper portion extending upwardly from the top of the bottle into a cork-receiving space provided in the holder. Then, upon continued rotation of the corkscrew in the same direction in which it was driven into the cork, but without further downward movement, the cork is caused to climb threadedly upwardly on the helical corkscrew out of the bottle and into the aforementioned cork-receiving space in the holder.

The downward movement of the corkscrew into the cork, and more importantly, the subsequent threaded climbing of the cork on the corkscrew, are made dramatically easy by a friction-reducing coating, such as a polytetrafluoroethylene, provided on the corkscrew.

Because the aforementioned mode of operation necessitates the passage of the pointed tip of the corkscrew completely through the cork and out through its lower end, that tip is specially formed so that, when it passes through the bottom of the cork, it will not tend to break off fragments of cork which could then fall into the wine.

U.S. Pat. No. 4,377,096 discloses a further improvement in such corkscrews wherein catch means are provided adjacent the cork-receiving space engageable with the cork as it emerges from the bottle to prevent it from rotating. This ensures the complete withdrawal of the cork from the bottle by the aforementioned threaded climbing movement on the corkscrew, so that not even a little bit of vertical pulling by the user is necessary, even with very hard and/or tight corks.

A so-called "pocket model" of the aforementioned type of cork extractor has been marketed. In this pocket model, the handle was removably mountable on the corkscrew by emplacing a socket in the handle downwardly over an upstanding hub at the upper end of the corkscrew. The socket and hub were generally of square cross-sectional configuration, so that torque could be transmitted between the handle and the corkscrew. The handle also had a lengthwise bore so that, when removed from the aforementioned hub, it could be emplaced lengthwise over the lower part of the corkscrew, thereby placing the apparatus in a more compact form for carrying in one's pocket or the like, while at the same time, providing a sheath to cover the pointed tip of the corkscrew and prevent it tearing the user's pocket.

In all of the aforementioned devices, the handle and corkscrew together make up a generally T-shaped assembly. The user operates the device by grasping the handle, turning it one "half-turn," i.e. approximately 180°, then releasing the handle and repositioning his hand for another half turn. This mode of operation is very natural and comfortable for the user, and may be perfectly acceptable for ordinary household use, wherein only one bottle of wine is opened at a given time, and there is no particular need for great speed in opening such bottle. However, as mentioned, waiters and other such specialized users may sometimes desire a faster operation.

Some prior art devices intended to be operated essentially by continuous rotation of a corkscrew or assembly including such corkscrew have been provided with cranks. Examples are shown in U.S. Pat. Nos. 427,099, 276,804 and 35,362. However, as can be appreciated, such cranks involve the assembly of several parts which increases the expense of the apparatus. Furthermore, because a bottle of wine must generally be held upright while opening it, and because the crank of such a device must therefore revolve in a generally horizontal plane, the knob of the crank is disposed on a vertical rotational axis and it is neither natural nor comfortable for the user to grip the knob in such position and effect a circular movement in a generally horizontal plane. Furthermore, such knobs and other features of such prior art cranks have made such devices unsuitable for those who need a compact device which can be easily carried in a pocket or otherwise on one's person.

Other devices, exemplified in the disclosure of French Pat. No. 1,201,854, have been made with removable handles, and in some instances, those handles have been made hollow so that they can slip lengthwise over the corkscrew helix when not in use. However, these handles have been secured to their respective corkscrews by being passed horizontally through an appropriate socket, closed in the vertical direction. This enabled an upward pull to be exerted on the corkscrew by the handle, but did not permit the transfer of radial forces.

Still other corkscrews or cork extracting apparatus have had handles having apertures therein oriented so that the user could insert a finger through the aperture and pull upwardly on the corkscrew. Examples are shown on pages 17, 20–28, 37, 40–41, 61, 65, 98, 101, 105 of the book *Corkscrews for Collectors* by Bernard M. Watney and Homer D. Babbidge, Sotheby Parke Bernet, N.Y., 1981.

SUMMARY OF THE INVENTION

The apparatus of the present invention comprises a movable portion including a helical corkscrew. A handle, including at least one elongate arm, is associated with the movable portion such that the arm may extend radially outwardly with respect to the corkscrew in an operating position of the handle. The arm has a restraining formation disposed distal the corkscrew in said operating position and adapted to engage a human finger and restrain such finger against movement radially outwardly with respect to the arm in said operating position.

The apparatus further comprises a holder portion including bottle-engaging means for positioning the holder portion with respect to a bottle, the bottle-engaging means in turn comprising stop means engageable with the bottle to limit downward movement of the holder portion with respect thereto. The holder portion further includes spacer means extending upwardly from the bottle-engaging means and defining an opening for receipt of the cork as it emerges from the bottle. Finally, the holder portion includes guide means supported on the spacer means, engageable with the movable portion, and adapted to allow rotational and longitudinal movement of the movable portion relative to the holder portion whereby the corkscrew can be driven downwardly into the cork, and to a lowered position with respect to the holder portion, upon rotation of the movable portion in a first direction.

The movable portion and the holder portion have force transmitting means interengageable, when the movable portion is in its lowered position, and adapted to cause the cork to be removed from the bottle upon further rotation of the movable portion.

It can thus be seen that substantially the entire operation may be performed by rotation of the handle, and thus, the corkscrew, first to drive the corkscrew into the cork and then to remove the cork from the bottle, this mode of use, coupled with the restraining means on the handle, permit such rotation to be accomplished by the user placing one finger in engagement with the restraining means and effecting a circular movement. It is never necessary for the user to remove his hand and reposition it, as has been necessary with conventional handle styles. This results in a much enhanced speed of operation.

The speed of operation is further enhanced, once the cork has been withdrawn from the bottle, in that the user may unwind the corkscrew from the cork by a similar continuous rotary motion without the need for constant removal and repositioning of his hand.

In addition, this one finger rotary operation places the user's hand and arm in positions which are much more natural and comfortable than if he were using a crank mechanism, considering the fact that the bottle of wine must be maintained in an essentially upright position during the operation.

The ability to perform the rotary operation with one finger, not only without discomfort, but indeed with great ease, is very much enhanced by two additional features of preferred embodiments of the apparatus.

First, the corkscrew comprises a central helical body of a suitable metal or the like with an outer layer of a friction-reducing material, such as a suitable polytetrafluoroethylene. This vastly reduces the torque which must be exerted in driving the corkscrew into the cork, and if the device is of the preferred type wherein continued rotation of the corkscrew in the same direction will cause the cork to climb threadedly upwardly on the corkscrew, such coating likewise dramatically reduces the torque which must be exerted in extracting the cork from the bottle.

Secondly, a relatively long operating arm is provided in the preferred embodiments. Preferably, the distance between the centerline of the corkscrew and the restraining formation on the handle, when the handle is in its operating position, is at least as great as the vertical length of the spacer means, which in turn is at least such as to accommodate a typical cork.

Preferred embodiments of the invention include a number of other salient features. For example, in order to provide a more compact configuration for storage or carrying of the device, the handle may either be pivotally connected to the movable portion of the apparatus, or may be removably connected thereto. However, if the handle is removably connected to the corkscrew, the means for effecting such connection, unlike those of prior removable handles, is such as to prevent radially outward movement of the aforementioned arm so that the user may conveniently allow his finger to bear slightly outwardly in rotating the handle without his finger slipping off.

Preferably, the handle is engageable and disengageable with the movable portion of the apparatus by downward and upwardly relative movement respectively. This not only provides for the necessary transfer of radial forces, but also positively prevents any substantial upward pulling on the corkscrew by the user when gripping the handle. This is quite helpful, for example, in emphasizing to new users that the manner of using the present apparatus is quite different from that of ordinary cork-extracting devices and in positively preventing misuse of the apparatus by trying to pull the cork out of the bottle.

Where the handle is removable, it may be provided with a bore extending generally lengthwise with respect to the handle arm and opening through one end of the handle. This bore is sized to receive that portion of the corkscrew which, when the movable portion is in its lowered position, extends downwardly from the guide means and generally through the holder. Thus, the handle can be stowed on such extending portion of the corkscrew when not in use to provide a particularly compact configuration for carrying or storage.

If the part of the handle defining the bore is long enough, it will extend slightly beyond the pointed tip of the corkscrew, thereby protecting the user, adjacent clothing or objects, etc. Furthermore, where the restraining formation of the handle is defined by an aperture extending through the handle transverse to the bore, and with the bore opening endwise into such aperture, such length also provides a safety feature for protecting the user's finger from the pointed tip of the corkscrew, should he inadvertently leave his finger in the aperture while stowing the handle on the corkscrew.

The handle may be formed in two telescoping parts. If so, then preferably one of the two parts has a bore long enough to receive the entire extending portion of the corkscrew when stowed. In any event, a telescoping handle makes possible a very long operating arm during operation, while still allowing a very compact configuration for storage or carrying. With a telescoping handle, the two parts of the handle may be equipped with means frictionally resisting retraction from the fully extended position of the two parts so that the handle will not collapse in use.

The unique one-finger operation of the present apparatus is further facilitated where the holder portion of the apparatus is of the type which positively grips the bottle neck, and provides a very accurate positioning of its guide means in coaxial alignment with the cork, thereby providing positive and very good guidance for the corkscrew in its movements with respect to the holder, and thus, the bottle. In preferred forms of the invention, the holder includes a pair of diametrically opposed radially flexible legs, joined at their upper ends by the guide means. The upper portions of these legs serve as the aforementioned spacer means, while the lower portions of the legs serve to grip the bottle neck.

It is a particular object of the present invention to provide a cork-extracting apparatus, of the type which is operated primarily by rotation of a movable portion including a corkscrew, adapted so that such rotation may easily be accomplished by the operating using a single finger and without the need for repeated repositioning of the operator's hand.

Another object of the present invention is to provide such an apparatus wherein the handle includes a radially outwardly extending arm having a restraining formation for engaging a human finger and restraining radially outward movement thereof.

Still another object of the present invention is to provide such an apparatus in which said restraining formation is positioned so as to provide a relatively long effective operating arm, and wherein the corkscrew has an outer coating of friction-reducing material.

A further object of the present invention is to provide such an apparatus in which the handle is comprised of two telescoping parts.

Still another object of the present invention is to provide such an apparatus in which the handle may be removed and stowed on the corkscrew, providing a protective sheath therefor.

Many other objects, features, and advantages of the present invention will be made apparent by the following detailed description, the drawings, and the claims.

BRIEF DESCRIPTION OF THE DRAWINGS

FIG. 1 is a front elevational view of a first embodiment of the present invention with the handle in its operating position and the movable portion in its lowered position.

FIG. 2 is a top plan view taken on the line 2—2 of FIG. 1.

FIG. 3 is a side elevational view taken on the line 3—3 of FIG. 2.

FIG. 6 is a transverse cross-sectional view taken on the line 6—6 in FIG. 5.

FIG. 7 is a transverse cross-sectional view of the handle taken on the line 7—7 in FIG. 1.

FIG. 8 is a transverse cross-sectional view of the handle taken on the line 8—8 in FIG. 1.

FIG. 9 is a transverse cross-sectional view taken on the line 9—9 of FIG. 4.

FIG. 10 is a detailed cross-sectional view of the corkscrew taken on the line 10—10 of FIG. 1.

FIG. 11 is a top plan view of an alternative embodiment of handle.

FIG. 12 is a side elevational view of the alternative handle taken on the line 12—12 of FIG. 11.

FIG. 13 is a side elevational view, partly in section, of another embodiment of apparatus according to the present invention with the handle in its operating position.

FIG. 14 is a top plan view of the apparatus of FIG. 13.

FIG. 15 is a view similar to that of FIG. 14 showing the handle in a carrying or storage position.

FIG. 16 is a side elevational view of yet another embodiment of apparatus according to the present invention.

FIG. 17 is a view similar to that of FIG. 16 showing the handle removed and the entire apparatus installed on a storage device.

FIG. 18 is a front elevational view taken on the line 18—18 of FIG. 17.

DETAILED DESCRIPTION OF THE PREFERRED EMBODIMENT

Figures 4, 5:
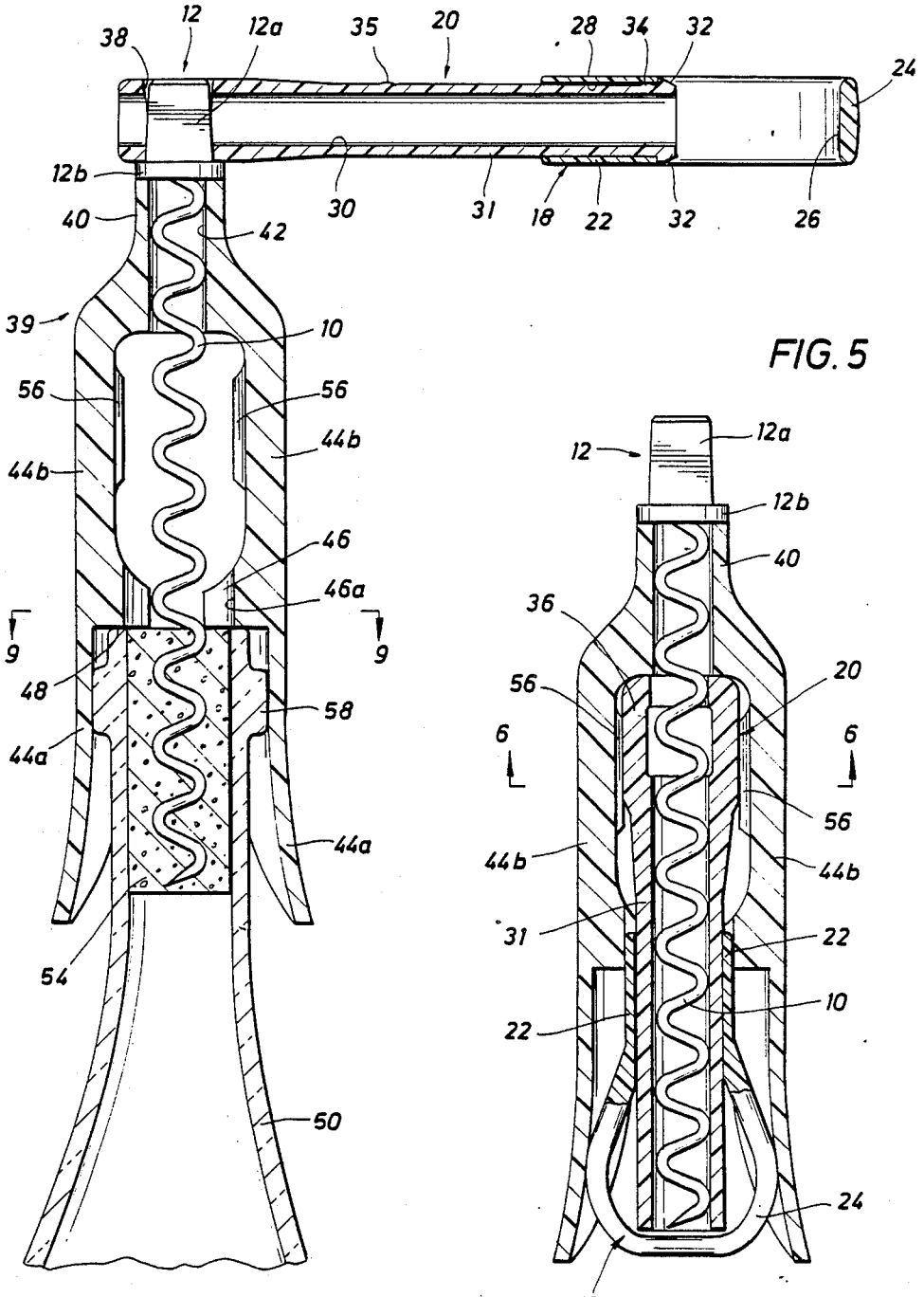
FIG. 4 is a longitudinal cross-sectional view taken generally on the line 4—4 of FIG. 2 and showing the apparatus in association with a wine bottle and part way through its operational cycle.
FIG. 5 is a longitudinal cross-sectional view of the apparatus of FIGS. 1-4 showing the handle in its stowed position.

Referring to FIGS. 1-9, there is shown a first embodiment of cork-extracting apparatus according to the present invention. Generally speaking, the apparatus comprises three main subassemblies or portions, a movable portion 10, 12, a handle 18, 20, and a holder portion 39.

As best shown in FIGS. 4 and 5, the movable portion includes the helical corkscrew proper, referred to hereinafter simply as the "corkscrew" 10 and a mounting base 12. The upper end of the corkscrew 10 is rigidly affixed to mounting base 12 in any suitable manner, and corkscrew 10 extends downwardly therefrom, terminating in a sharpened tip, which is preferably of the form described in U.S. Pat. Nos. 4,276,789, 4,291,597 and 4,429,444. (Throughout this specification, terms such as "vertical," "upward," and "downward" will be used with reference to the apparatus as illustrated in the drawings and as it would be positioned for use with respect to an upright bottle. Such terms are not otherwise intended in a limiting sense.)

The mounting base 12 includes an upstanding hub **12*a* of square transverse cross section (see FIG. 2). The sides of hub 12*a* are slightly tapered, so that its lateral dimensions increase or flare outwardly from top to bottom. At the lower end of hub 12*a*, mounting base 12 has a laterally outwardly extending flange 12*b*** which serves as an abutment means, in a manner described more fully hereinbelow.

Corkscrew 10 is further preferably of the form disclosed in said prior patents, which as best shown in FIG. 10, includes a central body 14 of metal and an outer layer 16 of a friction-reducing material, such as a suitable polytetrafluoroethylene. The relative thickness of layer 16 has been exaggerated in FIG. 10 for purposes of illustration.

The handle of the apparatus comprises two main parts, 18 and 20, each of which is preferably integrally molded of a suitable plastic having high tensile strength. The first part 18 of the handle includes an elongate shank 22 and an enclosure formation 24 integrally adjoined to one end of shank 22 and defining an aperture 26. Shank 22 has a bore 28 extending along its full length, opening into aperture 26 as well as outwardly through the end of shank 22 distal aperture 26. In FIGS. 1-4, handle 18, 20 is shown in a position which will be referred to hereinafter as its "operating position" in which the handle extends generally horizontally and aperture 26 opens vertically both upwardly and downwardly. Aperture 26 is sized to comfortably receive a human finger.

The second part 20 of the handle is generally tube-like, being elongate and having a bore 30 extending lengthwise therethrough and opening outwardly through both ends. A major section 31 of second handle part 20, i.e. that section adjacent the righthand end as viewed in FIGS. 1–4, has outer dimensions generally sized for sliding receipt in bore 28 of first handle part 18. However, at the end of part 20 adjacent part 18, there are formed two retainers 32 which project radially outwardly on diametrically opposite sides of said end of part 20. Due to the hollow configuration of part 20 and the nature of the material of which it is formed, retainers 32 can be forcibly inwardly deflected to pass the adjacent end of part 20 into and through bore 28 so that retainers 30 then lie within the confines of aperture 26. Retainers 32 may be bevelled, as shown, to facilitate such assembly. Thereafter, abutment of retainers 32 with the inner walls of aperture 26 adjacent bore 28 will limit telescopic extension of the two handle parts, while abutment of the adjacent end of part 20 with the inner walls of aperture 26 diametrically opposite bore 28 will limit telescopic retraction (see FIG. 5).

When the two parts are fully telescopically extended, as shown in FIGS. 1, 2 and 4, a small rounded projection 34 formed on the outer surface of part 20 will lie under shank 22 of first handle part 18. Projection 34 offers sufficient frictional resistance to telescopic contraction of the two handle parts so that they will not collapse during use. Nevertheless, projection 34 is small enough that its frictional resistance can be relatively easily overcome when it is desired to contract the handle, e.g. for storage, and a similar projection 35 will then underlie shank 22 to hold the handle parts in a retracted mode.

At the end of section 31 distal first handle part 18, second handle part 20 increases in outer lateral dimension through a transition section 33, and terminates in a short socket section 36 of generally square transverse cross-sectional configuration. A cross bore 38 extends through socket section 36 in the vertical direction when the handle is in its operating position. Cross bore 38 serves as a socket for receipt of hub 12*a* of the movable portion of the apparatus, whereby the handle and the movable portion can be releasably connected together. Cross bore 38 has a generally square cross-sectional configuration sized to mate with hub 12*a*. Thus, hub 12*a* and socket 38 have wrench surfaces whereby torque may be transmitted from handle 18, 20 to movable portion 10, 12 of the apparatus. The transverse dimensions of socket 38 are flared outwardly from its midpoint to each end. Thus, whether socket 38 is emplaced over hub 12*a* as shown in FIG. 4, or the handle is inverted, socket 38 will provide a tapered portion for snug receipt of hub 12*a*, but without difficulty in emplacement or removal thereon.

As best shown in FIGS. 7 and 8, while bore 30 is circular in transverse section, for a purpose to be described hereinbelow, the transverse cross-sectional configuration of the outer portion of section 31 is elliptical, as is the mating bore 28 in shank 22 of first handle part 18. This prevents relative rotation of the two handle parts.

When the movable portion 10, 12 of the apparatus is vertically disposed, with hub 12*a* uppermost, and handle 18, 20 is oriented horizontally, with socket 38 extending vertically, socket 38 can be emplaced on hub 12*a* by downward movement of the handle to releasably connect the handle to the movable portion of the apparatus. The handle will then lie in its operating position, and part 18, as well as the major portion of part 20 (up to socket 38) will extend laterally outwardly at one side of the movable portion forming an operating arm. It can be seen that, when thus assembled, the connection means formed by hub 12*a* and socket 38 not only will transmit torque for rotation about the centerline of the movable portion, but will also transmit radial forces either outwardly or inwardly along said operating arm. However, because the handle is removed from the movable portion by relative upward movement, the connection means 12*a*, 38 will not serve to transmit any substantial pulling force on handle 18, 20 to movable portion 10, 12.

The holder portion 39 of the apparatus, at its upper end, includes a guide bushing 40 having a vertically disposed cylindrical passageway 42 sized for sliding receipt of corkscrew 10 and permitting longitudinal and/or rotative movement thereof relative to the holder portion 39.

The holder 39 is generally of bifurcated configuration, including a pair of legs 44 joined at their upper ends by guide bushing 40. Legs 44 are diametrically opposed and spaced apart and extend generally downwardly from guide bushing 40.

Approximately midway along the length of the legs 44 are flanges 46 extending generally radially inwardly from respective legs 44. The undersides of flanges 46 define coplanar stop shoulders 48 which may rest on the top of a bottle, shown at 50 in FIG. 4, to limit downward movement of the holder with respect to such bottle.

The lower portions 44*a* of legs 44 below stop shoulders 48 are engageable with the sides of the bottle neck, as shown, and are referred to herein as grip means, since the flexibility of the material of which the holder portion is formed allows them to be flexed inwardly or outwardly to actually grip bottle necks of various sizes. Stop shoulders 48, along with gripping elements 44*a*, comprise the bottle-engaging means of the holder, which engages the bottle to properly position the holder 39 with respect thereto. The holder 39, in turn, properly positions the corkscrew 10 via guide passage 42.

The upper portions 44*b* of legs 44 space the guide bushing 40 above the top of the bottle 50 and define therebetween an opening 52 for receipt of the cork 54 as it emerges from the bottle. As shown in FIG. 9, flanges 46 have recesses 46*a* in their laterally inner sides to allow for passage of the cork upwardly, in a manner to be described more fully hereinafter.

On the inner side of each of the spacer means 44*b*, and slightly above the respective flange 46, is a vertically extending ridge 56. The innermost surfaces of ridges 56 are sharpened, so that as the cork moves upwardly and out of the bottle, these ridges may embed into the cork, thus serving as catch means to prevent rotation of the cork.

It is also important to note that not only the lower portions or gripping elements 44*a*, but also the upper portions or spacer elements 44*b* of legs 44 are radially deflectable. Indeed, the flexibility in the upper portions 44*b* is particularly important in allowing the gripping elements 44*a* therebelow to be moved radially inwardly or outwardly as needed to grip various bottle necks near the upper ends thereof, e.g. at the drip ring 58.

To begin operation of the device, the handle, if not already in its operating position, is placed in its operating position by lowering socket 38 over hub 12*a* and telescopically extending the two parts of the handle to the position shown in FIGS. 1 and 2. Next, the corkscrew 10, if not already inserted in guide passage 42, is so inserted. The holder poriton 39 of the apparatus is then lowered over the bottle neck and gripping elements 44*a* clasped against the bottle by one hand of the user. Although the movable portion and handle can be manually raised, abutment of the lower end of corkscrew 10 with the top of cork 54 will automatically raise the corkscrew, and the attached handle, to a position in which the handle is spaced above guide bushing 40 as the devie is lowered onto the bottle.

The pointed tip of corkscrew 10 may be started into the cork by exerting a slight downward push on handle 18, 20 and/or hub 12*a*. Thereafter, no further pushing or pulling is needed. More particularly, the user grasps gripping elements 44*a* with one hand to maintain firm engagement of those gripping elements and the adjacent stop shoulders 48 with the bottle. The user inserts one finger of the other hand into aperture 26. It is particularly noted that this hand of the user will lie in a natural and comfortable palm-down position. Then, the user rotates the movable portion of the apparatus, via handle 18, 20, by moving the finger inserted in aperture 26 continuously in a circle, i.e. with a spinning-type motion. During this operation, the user never needs to release and re-engage either hand, which saves a substantial amount of time.

It is particularly noted that the effective length of the operating arm, i.e. the distance between aperture 26 and the centerline of corkscrew 10, with the handle in its operating position, is substantially longer than the spacer elements 44b. This, coupled with the friction-reducing coating 16, so greatly reduces the torque needed to drive the corkscrew downwardly through the cork, that that operation can be performed by easily even though the user only exerts the rotary force with a single finger. It will be apparent that aperture 26 restrains the user's finger against radially outward movement, thereby further facilitating an extremely quick rotary operation.

As the handle 18, 20 is rotated to drive corkscrew 10 into cork 54, corkscrew 10, along with handle 18, 20, will naturally move downwardly simultaneously. Eventually, the movable portion 10, 12 of the apparatus will reach a lowered position in which flange 12*b* abuts the upper end of guide bushing 40. Thereafter, no further downward movement is possible. However, as shown in FIG. 4, corkscrew 10 is of such length that, in the lowered position, it will have been driven essentially through the entire length of cork 54, and will extend therefrom upwardly all the way through cork-receiving opening 52. Thus, without stopping, repositioning or changing the nature of the movement of the user's hand, i.e. by simply continuing to spin handle 18, 20 and thereby rotate corkscrew 10 in the same direction, but without further downward movement, the cork 54 will be caused to climb threadedly upwardly on corkscrew 10 into opening 52. After cork 54 has thus climbed a short distance from the bottle, it will be engaged by catch ridges 56, which will prevent rotation of the cork. This will permit complete removal of the cork from the bottle by ensuring that the cork does not begin to rotate jointly with the corkscrew, but rather, that it will climb threadedly upwardly thereon.

After the cork has been withdrawn from the bottle, the user may slightly loosen his grasp on gripping elements 44*a* and lift the holder portion 39 of the apparatus, along with the movable portion and handle, from the bottle. Then, with the finger of his other hand still confined in aperture 26, he will rotate the handle and the movable portion of the apparatus in the opposite direction from that used to perform the cork-withdrawing operation, i.e. counterclockwise. With catch ridges 56 embedded in the cork, and thereby preventing rotation thereof, this reverse spinning action will back the corkscrew 10 out of the cork. The cork can then be removed from the holder manually, or can be ejected through the lower end of the holder by simply lowering the handle and the movable portion of the apparatus in a straight downward stroke without rotation. The apparatus is now in position to begin another such sequence of operation.

It is particularly important to note that, unlike many conventional cork-extracting apparatuses, the present apparatus is operated virtually exclusively by rotary movement of the handle, and does not involve any upward pulling on the corkscrew. The method of connecting the handle 18, 20 to the movable portion 10, 12 helps to ensure proper operation in this regard. Specifically, because the handle is removed from the movable portion by relative upward movement, it is virtually impossible for the user to exert any substantial upward pull on the corkscrew with the handle. On the other hand, because of the spinning motion which the user will effect on handle 18, 20, and particularly because the finger engaged in aperture 26 will be exerting a radially outward force, it is important that such radial forces, particularly in the outward direction along the operating arm, be transmitted from the handle to the movable portion of the apparatus, and it can be seen that the vertically arranged hub 12*a* and socket 38 achieve this purpose.

When it is desired to carry and/or store the apparatus, the handle may be removed from the movable portion, and with the movable portion in its lowered position with respect to the holder, the lower end of corkscrew 10 may be inserted into that end of bore 30 in section 36. Handle part 20 is sized so that it is at least as long as that portion of corkscrew 10 which will depend downwardly from guide bushing 40 when it is in its lowered position. Thus, as shown in FIG. 5, the end of the corkscrew will not project beyond part 20 into aperture 26. Thus, even if the user inadvertently kept his finger in aperture 26 while inserting the handle lengthwise on the corkscrew as shown in FIG. 5, he would not be injured by the pointed tip of the corkscrew. The two handle parts 18 and 20 can be telescopically contracted either before, during or after the lengthwise insertion of corkscrew 10 into bore 30, and the handle will then be in its stowed position as shown in FIG. 5.

Although any number of means for retaining the handle in its stowed position could be employed, the present invention makes use of a frictional binding. The means for effecting such binding is shown, somewhat exaggerated in the drawing. In particular, socket section 36 of handle part 20 is sized so as to be engaged by ridges 56 when inserted into its stowed position. As best shown in FIG. 6, one of the ridges 56 extends laterally inwardly by a greater distance than the other, so that the midline between the two ridges is slightly offset from the centerline of guide bushing 40, and thus, the centerline of corkscrew 10. Corkscrew 10, in turn, is resiliently flexible. Thus, as handle part 20 is slipped lengthwise over the downwardly depending part of corkscrew 10, and as the ridges 56 engage socket section 36 of handle part 20, handle part 20 will be forced to the left as viewed in the drawing, and a frictional jamming effect between the handle, corkscrew and holder, will occur. This jamming effect is just sufficient to retain the handle in its stowed position against ordinary forces, but is not so great as to unduly resist removal of the handle from its stowed position for operation, nor to harm the corkscrew 10. With the two handle parts telescopically contracted, projection 34 will retain part 18 in a contracted position with respect to part 20.

Referring now to FIGS. 11 and 12, there is shown another form of handle which can be used with the apparatus of FIGS. 1–10 in place of handle 18, 20. The handle of FIGS. 11 and 12 is formed of a single, integrally-molded plastic part 60. At one end is a socket section 62 essentially identical to socket section 36 of the part 20 of the handle of the preceding embodiment. Section 62 has a cross bore 64 which serves as a socket for receipt of hub 12*a*. The line 1 in FIG. 12 lies in a plane passing perpendicularly through the midpoint of cross bore 64, and the lateral dimensions of cross bore 64 increase outwardly from line 1 and the plane in which it lies toward either end of cross bore 64. Handle 60 is elongated, extending outwardly at one side of socket section 62 to form the operating arm of the handle.

At the opposite end of this operating arm from socket 64 is a restraining formation generally designated 66. When viewed from the top, as in FIG. 11, restraining formation 66 may be generally described as a widened area on the outer end of the operating arm of handle 60 in which there are curved recesses 68 extending laterally inwardly on opposite sides of the handle. Thus, in this embodiment, the restraining formation does not define a complete enclosure, but does form a pair of hollows 68, opening both upwardly and downwardly, and configured to confine a human finger and restrain it against radial movement along the operating arm of handle 60. Because in use the radially outward force of the user's finger is the main force which needs to be restrained, the lateral protuberances 70 which define the outermost extremities of hollows 68 extend outwardly somewhat more than the protuberances 72 which define the inner extremities of the hollows 68.

A lengthwise bore 74 extends through handle 60 from end to end, intersecting cross bore 64, and passing through restraining formation 66. The length of handle 60 and the diameter of bore 74 are such that, when the movable portion 10, 12 of the apparatus is placed in its lowered position in the holder 39, handle 60 can be stowed on the portion of corkscrew 10 extending downwardly from the guide bushing 40 within the holder in the same manner as the handle 18, 20 of the preceding embodiment, and may be frictionally bound with the corkscrew and the holder to releasably retain it in such stowed condition.

Where the handle of the apparatus is formed in a single integral piece, as in FIGS. 11 and 12, it is desirable, both for aesthetic reasons and convenience, that the handle not extend substantially beyond the ends of gripping elements 44*a* when in its stowed condition. However, if the restraining formation were in the form of an aperture communicating with the central lengthwise bore of the handle, and this preferred handle length were used, then, when the handle was stowed, the pointed tip of the corkscrew would project into such aperture. This would present no particular problem once the handle was stowed, as the enclosure walls defining the aperture would shield the corkscrew tip from the user, the user's clothing, adjacent objects, etc. However, a user who had been operating the apparatus with his finger in such an aperture might, in haste or through inadvertence, attempt to stow the handle without removing his finger from the aperture, in which case he could be hurt by the pointed tip of the corkscrew while pushing the handle lengthwise up over the corkscrew. Thus, the form of restraining formation 66 of the embodiment of FIGS. 11 and 12 is particularly desirable, for safety reasons, where it is desired to use a one-piece handle with a holder and corkscrew dimensioned as in FIGS. 1–10, and of such length that the handle will not project substantially beyond the holder when stowed.

Operation using the handle 60 is much the same as the operation described hereinabove for the first embodiment of the invention. In particular, having properly placed the handle in its operating position, and position the apparatus with respect to a bottle of wine to be opened, the user grasps the holder gripping means with one hand, and places a finger of the other hand in one of the two hollows 68, specifically the one appearing uppermost in FIG. 11, then, as in the preceding embodiment, the user may perform the entire operation of driving the corkscrew downwardly to its lowered position, and then causing the cork to climb upwardly thereon, by continuous rotation of the clockwise direction without removal or repositioning of the finger in hollow 68. It is only after the apparatus has been removed from the bottle, and it is desired to unwind the corkscrew from the removed cork, that the holder will reposition his hand, this time with his finger in the lowermost of the two hollows as shown in FIG. 11. This single repositioning of the user's hand, particularly since his finger would likely be removed while taking the apparatus from the bottle in any event, is not a significant disadvantage.

Referring now to FIGS. 13–15, there is shown another embodiment of cork-extracting apparatus according to the present invention. The apparatus of FIGS. 13–15 includes a holder 76 which is virtually identical to the holder 39 of the preceding embodiments. The apparatus further comprises a movable portion much like that of the preceding embodiments in that it includes a corkscrew 78, identical to corkscrew 10, fixedly attached to, and extending downwardly from, a mounting base 80. Mounting base 80 includes a lowermost circular flange 80*a* which serves as an abutment for cooperation with the upper end of holder 76 to limit downward movement of the movable portion of the apparatus with respect to the holder 76 when the movable portion has reached its lowered position, as shown in FIG. 15. Above flange 80*a* is a hub 80*b* whose dimension is narrowed, as compared to flange 80*a*, in one transverse direction. Such narrowing forms shoulders 80*e* at the juncture between the flange 80*a* and the hub 80*b*. A hinge formation 80*c* is integrally adjoined to hub 80*b* at one side thereof, such side-to-side direction being measured along the greater of the lateral dimensions of hub 80*b*. Hinge formation 80*c* defines a bore 82 extending generally tangentially with respect to mounting base 80 in general.

The handle of the apparatus of FIGS. 13–15 is formed as a single, integrally-molded part 84. Handle 84 is elongated, one end having a clevis 86 formed thereon, and the other end having an enclosure 88 formed thereon and defining an aperture 90. Clevis 86 is pivotally connected to hinge formation 80*c* of the movable portion of the apparatus by a pin 92 which may be properly held in place by any suitable means as well known in the art. Thus, handle 84 may be pivotally moved from a carrying position, as shown in FIG. 15, wherein it lies generally alongside corkscrew 78, and if the movable portion is installed in the holder 76, also generally alongside the legs of holder 76, to an operating position, in which handle 84 overlies mounting base 80 and extends laterally outwardly therefrom on the opposite side of mounting base 80 from hinge formation 80*c*.

The portion of handle 84 thus extending laterally outwardly opposite hinge formation 80*c* is the operating arm of handle 84. Enclosure 88 is oriented so that, when the handle is in its operating position, aperture 90 opens both upwardly and downwardly. Thus, enclosure 88 serves as the restraining formation of handle 84 in much the same manner as enclosure 24 serves as the restraining formation in the embodiment of FIGS. 1–10.

Intermediate enclosure 88 and clevis 86, handle 84 has a lengthwise channel 94 which, when the handle is in its operating position, opens downwardly so that it may receive hub 80*b* of mounting base 80. Thus, the central web defining such channel may rest on the uppermost surface 80*d* of hub 80*b* while the edges of the lateral webs may rest on respective shoulders 80*e*. Accordingly, surfaces 80*d* and/or 80*e* serve as upwardly facing support surfaces supporting handle 84 in its operating position.

The operation of the embodiment of FIGS. 13–14 is essentially the same as for the preceding embodiments, except that the handle 84 is not removable from the movable portion of the apparatus, but rather, can be placed in a more compact configuration for storage or carrying by pivoting to the position shown in FIG. 15.

Referring finally to FIGS. 16–18, there is shown still another embodiment of the present invention. The embodiment of FIGS. 16–18 includes a holder 96 substantially identical to holders 39 and 76 hereinabove. Likewise, the apparatus of FIGS. 16–18 includes a movable portion substantially identical to the movable portion 10, 12 of the embodiment of FIGS. 1–10, and including a mounting base having abutment flange 98 and upstanding hub 100, as well as a corkscrew 102 extending downwardly from the mounting base 98, 100. The handle 104 includes a thickened section 106 defining a socket 108 for receipt of hub 100. The hub and socket are substantially identical to those described hereinabove, and in particular, have square cross-sectional configurations so as to provide wrench surfaces.

Extending laterally outwardly from one side of socket section 106 is the operating arm 110 of handle 104. At the outer end of operating arm 110 there is formed an enclosure 112 which defines an aperture for restraining the human finger during use, and which in the operating position, shown in FIG. 16, opens both upwardly and downwardly. A shorter arm 116 extends laterally outwardly from the opposite side of socket section 106 from operating arm 110. Handle 104 is removable from movable portion 98, 100, 102, but is not designed to be stowed on the corkscrew 102. Rather, both the holder 96, with the movable portion 98, 100, 102 installed therein, and the handle 104, are designed to be stored on a special decorative stand 118, which does not form a part of the cork-extracting apparatus per se.

Stand 118 includes a base 120 which may rest on a table top or the like, and an upstanding formation 122 generally simulating the shape of the upper end of a wine bottle. Thus, as shown in FIGS. 17 and 18, holder 96 may rest on formation 122 in the same manner that it would rest on a wine bottle in use. Because formation 122 is hollow, it can receive the corkscrew 102 when it is in its lowered position with respect to holder 96. A shoulder formation 124 projects laterally from formation 122, and has a socket 126 therein, opening upwardly. Socket 126 is sized to receive the smaller arm 116 of handle 104 so that the handle may be mounted on stand 118 in a vertical position alongside holder 96. A cover 128 may be emplaced over the apparatus, resting on a shoulder 130 on base 120, thereby forming a compact package.

The foregoing represent exemplary embodiments of the invention, but is will be readily apparent to one of skill in the art that numerous variations are possible within the spirit of the invention. In particular, the invention is particularly well adapted to those types of cork-extracting apparatus which, with the possible exception of first starting the pointed tip of the corkscrew into the cork, are operated virtually exclusively by rotary motion, at least in terms of the force exerted by the user. In such apparatus, the holder and the movable portion will have some type of force transmitting means, engageable when the movable portion has reached its lower position with respect to the holder, and adapted to cause the cork to be withdrawn from the bottle as the movable portion is further rotated.

In the preferred embodiments shown, the corkscrew is designed and associated with the holder in such a way that, when it is in its lowered position, the cork may climb threadedly upwardly thereon if the corkscrew is rotated in the same direction in which it was driven into the cork without further downward movement, and in these embodiments, the force transmitting means are simply abutment means cooperative between the movable portion and the holder portion to prevent further relative downward movement of the movable portion.

However, in other embodiments, generally utilizing schemes known in the art, other kinds of force-transmitting means may be provided. For example, in some such designs, the movable portion of the apparatus could be provided with a force-transmitting screw, distinct from the corkscrew proper. A nut, follower tooth or the like could be provided for cooperating between this second screw and the holder so that, once the corkscrew had been driven into the cork, further rotation of the movable assembly, either in the same or an opposite direction, would cause the movable portion of the apparatus to be urged upwardly, carrying the cork and corkscrew with it. In such schemes, the second screw ordinarily has a much shorter pitch than the corkscrew proper, and this can reduce the operational torque sufficiently so that one finger rotation is practical.

In the preferred embodiments illustrated, the holder portions are designed for actually gripping or clasping the neck of the bottle. This is extremely advantageous in the particular kind of apparatus according to the present invention, because of the relatively large radius circle in which the handle and the user's operating hand will be revolving. However, in less preferred embodiments, it would be possible to provide a holder which simply rests on the upper end of the bottle as in more conventional cork-extracting apparatus.

Other modifications may be made in the handle and/or its means of association with the movable portion of the apparatus. In still other embodiments, particularly when compactness for storage or carrying is not a consideration, the handle might be permanently fixedly attached to the movable portion in its operating position.

Many other modifications will suggest themselves to those of skill in the art. Accordingly, it is intended that the present invention be limited only by the claims which follow.

What is claimed is:

1. Apparatus for extracting a cork from a bottle, said apparatus being of the self-puller type comprising:

a movable portion comprising a corkscrew including a generally helical central body and an outer layer of friction-reducing material, and downwardly facing abutment means carried on said corkscrew;

a handle including at least one elongate arm, said handle being associated with said movable portion such that said arm may extend radially outwardly with respect to said corkscrew in an operating position of said handle, said arm having a restraining formation dispose distal said corkscrew in said operating position, and adapted to engage a human finger and restrain such finger against movement radially outwardly with respect to said arm in said operating position thereby facilitating continuous rotation of said arm by more than 360°, about the axis of said corkscrew, buy such finger;

and a holder portion comprising bottle-engaging means for positioning said holder portion with respect to such bottle, said bottle-engaging means including stop means engageable with the top of such bottle for limiting downward movement of said holder portion with respect to such bottle, and a plurality of circumferentially spaced gripping elements extending below said stop means, said gripping elements being radially deflectable for gripping the sides of such bottle;

spacer means extending upwardly from said bottle-engaging means and defining an opening for receipt of a cork as it emerges from such bottle;

and guide means supported on said spacer means, engageable with said movable portion, and adapted to allow rotational and longitudinal movement of said movable portion relative to said holder portion, whereby said corkscrew can be driven downwardly into such cork and to a lowered position with respect to said holder portion upon rotation of said movable portion, said guide means having upwardly facing abutment means engageable with said abutment means of said movable portion to limit downward movement of said movable portion with respect to said holder portion to said lowered position;

said corkscrew being of a length such that, when in said lowered position, said corkscrew extends downwardly below said stop means as well as upwardly into said cork-receiving opening whereby, after said helical body has been so driven into such cork and to said lowered position, then such cork may move threadedly upwardly on said corkscrew as said corkscrew is further rotated without longitudinal movement.

2. The apparatus of claim 1 wherein said restraining formation defines a hollow configures to confine such human finger and opening generally upwardly in said operating position.

3. The apparatus of claim 2 wherein said hollow is defined by an aperture sized and configured to substantially surround such human finger.

4. The apparatus of claim 1 wherein the distance between the centerline of said corkscrew and said restraining formation, with said handle in said operating position, is at least as great as the vertical length of said spacer means.

5. The apparatus of claim 2 wherein said holder portion comprises at least two circumferentially spaced legs, the upper portions of said legs defining said spacer means, and the lower portions of said legs defining said gripping elements, said stop means being defined by shoulders formed generally intermediate the upper and lower portions of said legs.

6. The apparatus of claim 5 wherein said legs are diametrically opposed and separate from each other along substantially their entire length, said legs being connected to each other adjacent their upper ends by said guide means.

7. The apparatus of claim 1 wherein said handle is pivotally connected to said movable portion adjacent the upper end thereof, said handle being pivotally movable from a resting position, lying generally alongside said corkscrew, to said operating position.

8. The apparatus of claim 7 wherein said movable portion comprises an uppermost mounting base, said corkscrew being fixedly mounted in said mounting base and extending downwardly therefrom, said handle being so pivotally mounted on one lateral side of said mounting base, said handle overlying said mounting base in said operating position, and said mounting base having an uppermost support surface engageable with said handle to support said handle in said operating position.

9. The apparatus of claim 1 wherein said handle and said movable portion are releasably connectable, said handle and said movable portion having respective connection means comprising wrench surfaces whereby said movable portion may be rotated by said handle, and said connection means further being adapted to prevent radially outward movement of said arm when said handle is in said operating position.

10. The apparatus of claim 9 wherein said connection means are engageable, when said handle is positioned with said arm extending laterally with respect to said movable portion, by relative downward movement of said handle to mount said handle on said movable portion in said operating position, and are separable by relative upward movement of said handle.

11. The apparatus of claim 10 wherein said connection means are further operative to prevent radially inward movement of said arm.

12. The apparatus of claim 11 wherein said connection means comprises an upstanding hub on said movable portion and a socket, adapted for receipt of said hub, in said handle and spaced from said restraining formation.

13. The apparatus of claim 12 wherein said handle comprises first and second elongate handle elements, said first handle element having a bore telescopically receiving said second handle element for extension and retraction of the length of said arm.

14. The apparatus of claim 13 wherein said restraining formation is an enclosure sized and configured to substantially surround a human finger.

15. The apparatus of claim 14 wherein said enclosure defines an aperture opening upwardly and downwardly in said operating position.

16. The apparatus of claim 14 wherein said enclosure is formed on said first handle element, said bore of said first handle element extending transverse to said enclosure and opening thereinto at one end of said bore.

17. The apparatus of claim 16 wherein one end of said second handle element is so telescopically mounted in said bore of said first handle element and extending therefrom into said enclosure, said one end of said second handle element having retainer means projecting laterally outwardly therefrom for engagement with the inner wall of said enclosure adjacent the end of said bore of said first handle element to limit such telescopic extension, the inner wall of said hollow opposite said bore of said first handle element being engageable with said one end of said second handle element to limit such telescopic retraction, and the other end of said second handle element projecting outwardly from said first handle element and having said socket formed therein.

18. The apparatus of claim 17 wherein said second handle element has a central bore therethrough from end to end.

19. The apparatus of claim 18 wherein said retainer means are forcibly inwardly deflectable to allow assembly of said one end of said second handle element into said bore of said first handle element.

20. The apparatus of claim 19 wherein said first and second handle elements have means frictionally engageable, when said handle elements are telescopically retracted, to yieldably resist telescopic extension.

21. The apparatus of claim 20 wherein said first and second handle elements have means frictionally engageable, when said handle elements are fully telescopically extended, to yieldably resist telescopic retraction.

22. The apparatus of claim 18 wherein said bore of said second handle element is sized for lengthwise receipt of said corkscrew, whereby, when said handle is removed from said movable portion, and said movable portion is disposed in said lowered position with respect to said holder portion, said handle may be stowed on that part of said corkscrew extending downwardly from said guide means by inserting such extending part of said corkscrew into said bore of said second handle elements.

23. The apparatus of claim 22 wherein said bore of said second handle element is at least as long as such extending part of said corkscrew.

24. The apparatus of claim 23 including means for releasably frictionally binding said handle in such stowed disposition on said holder.

25. The apparatus of claim 24 wherein said holder portion comprises diametrically opposed inner surfaces facing laterally inwardly toward said corkscrew and sized for frictional engagement with the outer surfaces of said handle when said handle is thus stowed, the midline between said inner surfaces being slightly offset from the centerline of said guide means, and said corkscrew being resiliently flexible.

26. The apparatus of claim 25 wherein said inner surfaces are on said spacer means and are so frictionally engageable with the outer surfaces of said other end of said second handle element.

27. The apparatus of claim 12 wherein the side walls of said hub are tapered laterally outwardly from their upper to their lower extremity, and wherein said socket has correspondingly tapered side walls.

28. The apparatus of claim 27 wherein said socket is defined by a cross bore extending transversely through said handle, said cross bore being tapered outwardly from its midplane to each end.

29. The apparatus of claim 1 wherein said handle has a bore extending along the length of said arm and opening through one end of said handle, said bore being sized for lengthwise receipt of said corkscrew, whereby, when said handle is removed from said movable portion, and said movable portion is disposed in said lowered position with respect to said holder portion, said handle may be stowed on that part of said corkscrew extending downwardly from said guide means by inserting such extending part of said corkscrew into said bore of said handle.

30. The apparatus of claim 29 wherein said bore of said handle is at least as long as such extending part of said corkscrew.

31. The apparatus of claim 30 including means for releasably frictionally binding said handle in such stowed disposition on said holder.

32. The apparatus of claim 1 wherein said friction-reducing material is polymeric.

33. The apparatus of claim 1 wherein said holder further comprises catch means disposed adjacent said cork-receiving opening engageable with said cork as it emerges from said bottle to prevent relative rotation between said cork and said holder portion.

* * * * *

UNITED STATES PATENT AND TRADEMARK OFFICE

CERTIFICATE OF CORRECTION

PATENT NO. : 4,703,673

DATED : November 3, 1987

INVENTOR(S) : Herbert Allen

It is certified that error appears in the above-identified patent and that said Letters Patent is hereby corrected as shown below:

Column 15, line 28, "buy" should be changed to --by--.

Column 15, line 67, "configures" should be changed to --configured--.

Column 16, line 11, "2" should be changed to --4--.

Column 17, line 51, "elements" should be --element--.

Signed and Sealed this

Tenth Day of May, 1988

*Attest:*

*Attesting Officer*

DONALD J. QUIGG

*Commissioner of Patents and Trademarks*